US005566595A

United States Patent [19]

Goff

[11] Patent Number: 5,566,595

[45] Date of Patent: Oct. 22, 1996

[54] SOCKET MOUNTING ARRANGEMENT

[75] Inventor: Thomas R. Goff, Campbellsville, Ky.

[73] Assignee: Socket Retainer Systems, Inc., Campbellsville, Ky.

[21] Appl. No.: 350,332

[22] Filed: Dec. 6, 1994

Related U.S. Application Data

[63] Continuation-in-part of Ser. No. 110,984, Aug. 24, 1993, abandoned.

[51] Int. Cl.[6] ..... B25B 23/16

[52] U.S. Cl. ..... 81/177.85; 403/325

[58] Field of Search ..... 81/177.2, 177.85; 279/2 R, 75, 76; 403/365, 367, 325

[56] References Cited

U.S. PATENT DOCUMENTS

| | | | |
|---|---|---|---|
| 1,864,466 | 6/1932 | Peterson | 81/177.85 X |
| 4,537,100 | 8/1985 | Palm | 81/177.85 |
| 4,768,405 | 9/1988 | Nickipuck | 81/177.85 |
| 4,781,085 | 11/1988 | Fox | 81/177.85 |
| 4,817,476 | 4/1989 | Karge | 87/177.85 |
| 5,289,745 | 3/1994 | Bearosley | 81/177.85 X |

*Primary Examiner*—James G. Smith
*Attorney, Agent, or Firm*—Middleton & Reutlinger; David W. Carrithers

[57] ABSTRACT

A drive shaft socket mounting arrangement to receive a socket or other tool having a tool end with a selected geometrically configured cross section to receive a tool to be attached to the shaft where a central, axial, bore is provided in the shaft and adapted to receive a slide. A first hole of selected first diameter is provided diametrically through the shaft a selected distance from the end of the shaft and passes through the axial bore. An elongate ring forms a sleeve having a cross drilled hole of second diameter smaller than the first diameter where the ring has a selected internal diameter larger than the diameter of the shaft is provided so that the sleeve is received on the shaft and so the cross drilled hole can be aligned with the first hole and where the sleeve has a lip adjacent the end opposite the end of the shaft so a portion of the sleeve forms an annular opening between the shaft surface and the inner surface of the sleeve. A pin having a diameter approximately equal to the diameter of the cross drilled hole is received in the crossdrilled hole and extends diametrically through the sleeve and shaft. A slide member is received in the axial bore and has a diametrically extending second hole positioned so that the pin extends through the second hole and the slide can be moved longitudinally in the axial bore by longitudinal movement of the sleeve on the shaft which moves the pin in the first hole. A radial cross drilled hole is provided in the tool end to receive a ball which can be positioned outwardly from the surface of the tool end to be received in a groove in the tool to be attached to the tool end and retracted into the tool end to release the tool. The slide has a groove in the surface thereof and can be moved from a first position to receive the ball to remove the ball from the tool to a second position to urge the ball into the tool. A spring is provided to urge the sleeve and slide to the second position where the slide is moved to the first position by movement of the sleeve.

28 Claims, 2 Drawing Sheets

SOCKET MOUNTING ARRANGEMENT

This application is a continuation-in-part of my application Ser. No. 08/110,984 filed Aug. 24, 1993 now abandoned.

BACKGROUND OF THE INVENTION

The present invention relates to rotatable tooling, including wrenches, and more particularly relates to a socket mounting arrangement to secure a wrench socket or drive shaft adapter to a shaft having a selectively configured end section, such as square where the socket or other tool has a cooperative opening shaped aperture to receive the shaft end. Heretofore, sockets, adapters and other tools have been attached directly to the shaft end by various means. The purpose of the attachment is to prevent the escape of the socket or tool from the shaft when the tool is in use. More particularly, devices within the scope of the present invention are particularly useful for attachment of various tools to shaft members driven by, for example, hand or air motors.

The prior art teaches various means for attaching a tool or adapter to the shaft and more particularly for using the "dimple" provided inside the recess of the tool. Prior art methods for attachment of the tool or shaft adapter to the shaft have proven less than entirely effective for various reasons. One arrangement for attaching a tool to a shaft is shown in my prior U.S. Pat. No. 4,932,293 where a pin is provided for insertion into a recess in the shaft to which the tool is secured. Another arrangement is shown in U.S. Pat. No. 4,962,682 and U.S. Pat. No. 4,938,107. Various other arrangements are known which utilize retainer pins but in these cases the retainer pins usually extend through an aperture in the shaft where the pin and the aperture must be in specific alignment. On the contrary, devices within the scope of the present invention allow the adapter or tool to be easily secured to the shaft. Specific orientation of a pin and aperture is not required thus facilitating location of the tool or adapter on the shaft and saving time and effort.

The prior art also includes other arrangements for securing a tool or adapter to a shaft. One example is shown in U.S. Pat. No. 4,266,453, Farley, which teaches an elastomeric ring having a leg which is inserted through an aperture in the cooperative socket member and is received in an aperture in the shaft member which again requires specific alignment. U.S. Pat. No. 3,549,160 teaches a socket retaining assembly including a pin which is received through an aperture in the socket and spindle.

No prior art teaching is known which provides arrangements within the scope of the present invention.

SUMMARY OF THE INVENTION

The present invention provides economical straightforward methods and apparatus for efficiently, effectively and positively securing a tool such as a wrench socket or an adapter to a shaft used to position and rotate the tool. Devices in accordance with the present invention provide a shaft which is easily inserted onto a tool which is secured thereto with minimum effort without the need for alignment of the elements needed to retain the tool on the shaft. The ability to secure the tool to the shaft without the time required for alignment greatly reduces the time required for assembly. In applications where tools are changed frequently the time savings can be significant and the ability to effect the changes with minimum manipulation of the elements diminishes the liklihood of release of the tool or adapter from the shaft and the further reduces the liklihood of damage or injury.

More particularly, devices within the scope of the present invention are easily and economically fabricated and provide a useful, unique means for positively retaining a shaft in an aperture of a tool to prevent separation of the tool and the shaft.

Briefly, the present invention provides a drive shaft or drive shaft end for receiving a socket or other tool having a tool end with a selected geometrically configured cross section to receive the tool to be attached to the shaft where a central, axial bore is provided in the shaft and adapted to receive a slide. A first hole of selected first diameter is provided diametrically through the shaft a selected distance from the end of the shaft and passes through the axial bore. A sleeve having a cross drilled hole of second diameter smaller than the first diameter where the sleeve has a selected internal diameter larger than the diameter of the shaft is provided so that the sleeve is received on the shaft and so the cross drilled hole can be aligned with the first hole and where the sleeve has a lip adjacent the end opposite the end of the shaft so a part of the sleeve forms an annular opening between the shaft surface and the inner surface of the sleeve. A pin having a diameter approximately equal to the diameter of the cross drilled hole is received in the crossdrilled hole and extends diametrically through the sleeve and shaft. A slide member is received in the axial bore and has a diametrically extending second hole positioned so that the pin extends through the second hole and the slide can be moved longitudinally in the axial bore by longitudinal movement of the sleeve on the shaft which moves the pin in the first hole. A radial cross drilled hole is provided in the tool end to receive a ball which can be positioned outwardly from the surface of the tool end to be received in a groove in the tool to be attached to the tool end and retracted into the tool end to release the tool. The slide has a groove in the surface thereof and can be moved from a first position to receive the ball to remove the ball from the tool to a second position to urge the ball into the tool. A spring is provided to urge the sleeve and slide to the second position where the slide is moved by movement of the sleeve.

An example of an arrangement within the scope of the present invention is shown in the accompanying drawings and described hereinafter but it will be recognized that neither the illustration of the example of a device within the scope of the present invention nor the description thereof are by way of limitation and that other arrangements also within the scope of the present invention will occur to those skilled in the art upon reading the disclosure set forth hereinafter.

BRIEF DESCRIPTION OF THE DRAWINGS

Referring now to the accompanying drawings which illustrate one example of an arrangement within the scope of the present invention.

DETAILED DESCRIPTION OF THE DRAWINGS

Figure 1:
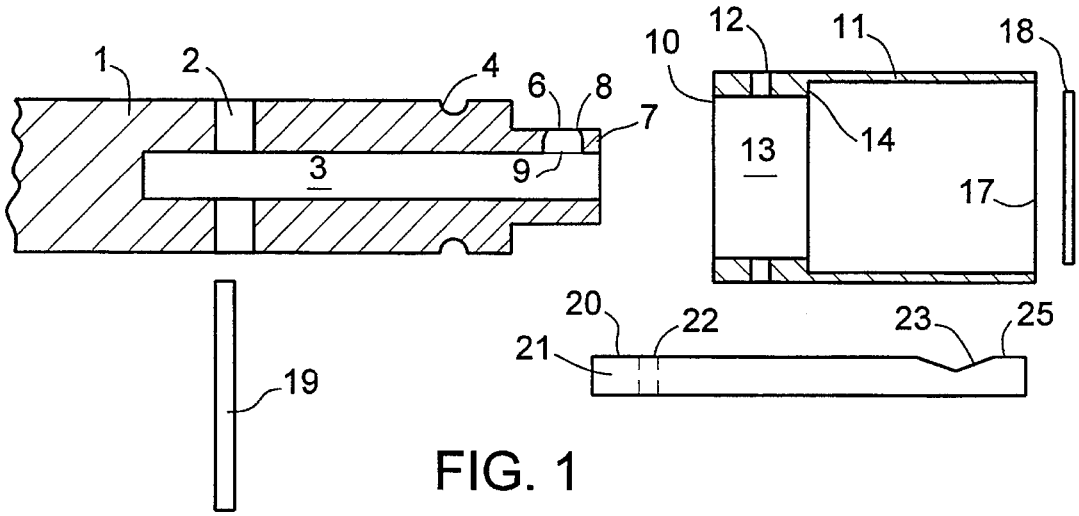
FIG. 1 is an exploded view in cross-section of an arrangement within the scope of the present invention showing a shaft.

Referring now to FIG. 1 which shows elements if a device in cross-sectional exploded view, a body member, which is typically a shaft 1 adapted to receive a socket or other tool, is illustrated. The shaft 1 comprises an elongated extension shaft 1 having a wrench drive section at one end and a socket drive stud at an opposite socket drive male end 7 having a plurality of side walls for cooperatively engaging a cavity formed within a tool socket. The end 7 provides a selected cross-section to receive a tool such as a socket to be turned by rotation of the shaft 1 as is known in the art.

A centrally bored hole 3 is provided in shaft 1 which extends through end 7 as shown. The diameter of hole 3 is selected to receive a slide 21 as shown and described later so that slide 21 can move longitudinally in the hole 3. A cross-drilled hole 2 is provided and in the arrangement shown in FIG. 1 hole 2 is located on a diameter of the shaft 1. The diameter of hole 2 is selected relative to the diameter of a pin 19 which is received in hole 2 where the diameter of hole 2 is larger than the diameter of pin 19 so that pin 19 can be moved along the longitudinal axis of body 1 as described in more detail hereinafter.

Shaft 1 is also provided with a circumferential groove 4 adapted to receive a ring 18 such as a "C" ring to retain a spring described hereinafter.

Also, a radially cross-drilled hole 6 is provided in one side of end 7 to intersect hole 3. The opening 9 on the inner surface of the hole 6 is full diameter while the outlet 8 of the hole is restricted by "peening" or other means such as the use of an insert so that a ball, described hereinafter, can travel freely in the hole 6 but be retained therein by the restricted outlet 8 and the slide member 21 inserted in hole 3 as also described hereinafter.

Slide 21, as shown in FIG. 1 can be of circular or other suitable cross-sectional configuration and has a cross drilled hole 22 near the inner end of the main body portion 20 of the slide 21 of a diameter to receive pin 19 when the unit is assembled as described hereinafter. A groove or notch defining a tapered portion 23 is also provided in slide 21 adjacent the end thereof opposite the end closest to hole 22. Groove 23 is located on slide 21 at a selected position near the distal end or slide head 25 and of sufficient depth so that when the slide is in hole 3 groove 23 is cooperatively located with respect to hole 6 so that the ball member described hereinafter located in hole 6 can be received on the groove or urged into the hole 6 all as described hereinafter.

The final element shown in FIG. 1 is a sleeve 11 to be received coaxially around the shaft 1 near the male end, wherein the sleeve 11 includes a first portion 10 of a selected internal diameter and a second portion 17 of a selected larger diameter forming a lip 14 thereinbetween. The diameter of the opening defined by lip 14 is selected to allow the sleeve 11 to receive shaft 1 as shown in FIGS. 2 and 3.

Figure 2:
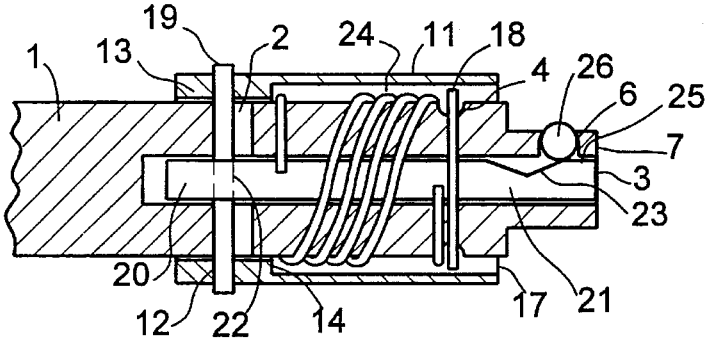
FIG. 2 is a cross-sectioned view of one example of an arrangement within the scope of the present invention showing the shaft shown in FIG. 1 in assembled form.
Figure 3:
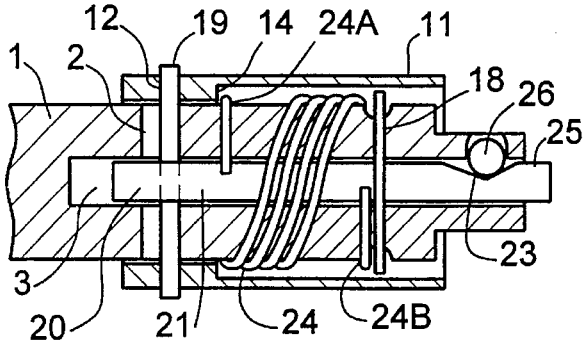
FIG. 3 is across-section view of the shaft arrangement shown in FIG. 2 in second position.

FIG. 2 illustrates the elements of FIG. 1, and a latch ball 26 and spring 24 in assembled relation to provide the means to lock a tool, for example a socket wrench onto end 7 of shaft 1.

As shown, shaft 1 is received in the opening 13 of sleeve 11 defined by lip 14 of the sleeve 11. Pin 19 is inserted through holes 12 of sleeve 11, hole 2 of shaft 1 and hole 22 of slide element 21.

Spring 24 having spring ends 24A and 24B is located on shaft 1 as shown and is restrained in cooperative contact with sleeve 11 18, which has been placed in groove 4, and the lip edge 14. It will also be noted that in the configuration shown in FIG. 2, spring 24 has urged sleeve 11 to the left relative to shaft 1. Since slide 21 is securely connected to sleeve 11 by means of pin 19 as also shown, slide 21 has been moved as far left as the diameter of hole 2 of shaft 1, which receives the pin 19, will allow. In the position shown in FIG. 2, the groove 23 of slide 21 is located so that the side of the groove 23 contacts ball 26 and urges it upwardly so that a portion of the ball 26 extends out of hole 6 and the ball 26 is retained by the previously described restriction at the outlet 6 of the hole 6. In this position, ball 26 advantageously extends far enough above the surface of end 7 to engage the cooperative depression typically provided on the interior surface of the female connecting end of a socket or other tool so that the tool is retained on the end 7 by the presence of the ball in the depression.

FIG. 3 is a cross-sectional view of the arrangement shown in FIG. 2 where the sleeve 11 has been moved to position for release of the tool (not shown) from the end 7 of shaft 1. Specifically, sleeve 11 has been moved forward on shaft 1 so that pin 19 engages the side of hole 2 opposite the side engaged in the view shown in FIG. 2. The slide 21 has thus been moved to the right relative to shaft 7 so that the deeper part of the groove 23 is in alignment with hole 6 of end 7. The increased depth allows ball 26 to retract from hole 6, as shown, so that a tool which is located on the end can be removed from the end wherein the forward motion of the sleeve 11 toward the socket driven end release the socket.

Figure 4:
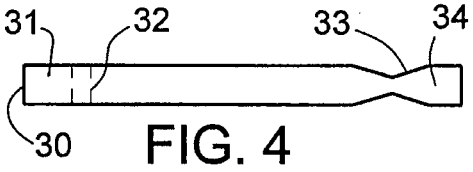
FIG. 4 is another version of a slide useful in the arrangement shown in FIG. 1.
Figure 5:
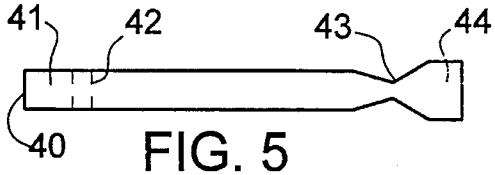
FIG. 5 is another version of a slide useful in the arrangement shown in FIG. 1.

FIGS. 4 and 5 illustrate alternative designs for slide members useful in devices of the type contemplated by the present invention.

The design shown in FIG. 4 provides a groove 33 surrounding the slide member 31 defining a coaxial tapered notch and could be used if a retaining means were used to connect the slide 31 to the sleeve 11 which allowed rotation of the slide member 31 having a hole 32 formed therein.

FIG. 5 is an illustration of an example of a slide member 41 having a hole 42 therein where an enlarged end 44 is provided outboard of groove 43 so that additional movement of the ball transverse to the axis of the shaft can be provided.

Figure 6:
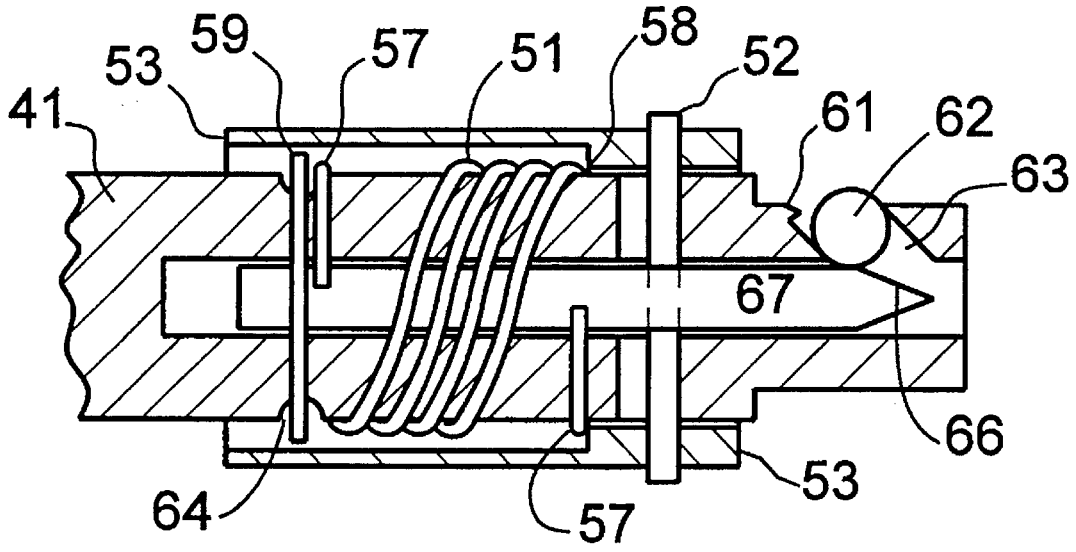
FIG. 6 is a cross-sectional view of another arrangement within the scope of the present invention.
Figure 7:
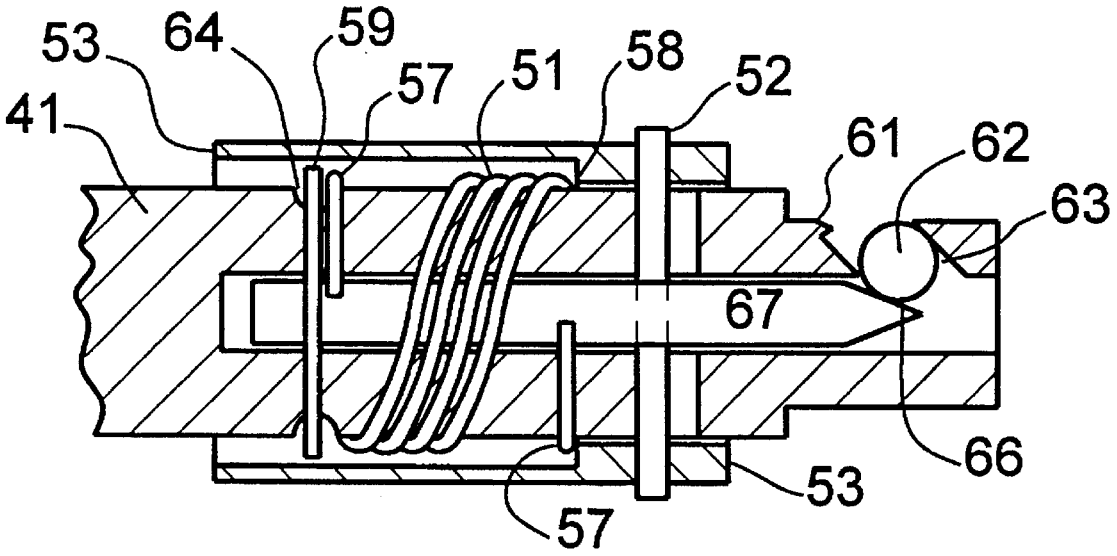
FIG. 7 is a cross-sectional view of the example of FIG. 6 with the retaining ball in retracted position.

The objectives of the present invention can be accomplished by numerous means and FIGS. 6 and 7 illustrate yet another arrangement within the scope of the present invention.

In FIG. 6 an arrangement is shown including elements of a device in cross-sectional view. A shaft 41 which is typically a shaft adapted to receive a socket or other tool, is illustrated. An end 67 is provided which can be of selected cross-section to receive a tool such as a socket wrench to be turned by rotation of the shaft 41 as is known in the art.

A centrally bored hole 43 is provided in shaft 41 which extends through end 67 as shown. The diameter of hole 43 is selected to receive a slide 68 as shown and described later so that slide 68 can move longitudinally in the hole 43. a cross-drilled hole 42 is provided and in the arrangement shown in FIGS. 6 and 7 hole 42 is located on a diameter of the shaft 41. The diameter of hole 42 is selected relative to the diameter of a pin 52 which is received in hole 42 where the diameter of hole 42 is larger than the diameter of pin 52 so that pin 52 can be moved along the longitudinal axis of body 41 as described in more detail hereinafter. Body 41 is also provided with a circumferential groove 64 adapted to receive a ring 59 such as a "C" ring to retain a spring described hereinafter.

Also, an angle drilled hole 63 is provided in one side of end 67 to intersect hole 43. The opening on the inner surface of the hole 63 is full diameter while the outlet 61 of the hole is restricted by "peening" or other means such as the use of an insert so that a ball 62, described hereinafter, can travel freely in the hole 63 but be retained therein by the restricted outlet 61 and the slide member 68 inserted in hole 43 as also described hereinafter. Slide 68, as shown in FIGS. 6 and 7 can be of circular or other suitable cross-sectional configuration and has a cross drilled hole of a diameter to receive pin 52 when the unit is assembled as shown in the Figures. An inclined surface 66 is also provided at the end of slide 68. Inclined surface 66 is located on slide 68 so that when the slide is located as shown in FIG. 6 the inclined surface is cooperatively located with respect to hole 63 so that the ball member 62 located in hole 63 is urged into the hole 63 and out of the hole to engage a cooperative depression in the tool received on the shaft end 67.

As previously described with reference to FIGS. 1–3 a sleeve 53 is provided which has a lip 58 adjacent an end thereof. The diameter of the opening defined by lip 59 is selected to allow the sleeve to receive body 41 as shown in FIGS. 6 and 7.

As previously described a spring 51 having distal ends 57 and 64, respectively, can be located as shown to hole slide 68 in the position shown in FIG. 6 where ball 62 is in engagement with the tool to be received on the tool end.

FIG. 7 is an illustration of an arrangement where the sleeve 53 has been moved against the spring force, to the left relative to the view shown in FIG. 7, so that the inclined surface is moved away from hole 63 and allows ball 62 to recede from outlet 61 of hole 63 which would allow the tool (not shown) to be removed.

It will be understood that the foregoing are but a few examples of arrangements within the scope of he present invention and that other arrangements also within the scope of the present invention will occur those those skilled in the art upon reading the disclosure set forth hereinbefore.

The invention claimed is:

1. A socket wrench extension mounting arrangement, comprising:

an elongated extension shaft having a wrench drive section at one end and a socket drive stud at an opposite socket drive male end;

said socket drive stud having a plurality of side walls for cooperatively engaging a cavity of a tool socket;

a latch ball projecting a selected distance from an opening formed in one of said plurality of said side walls having a top portion of lesser diameter than said opening adapted for retaining said ball and engaging a retaining means in the cavity of said tool socket;

said shaft having an axially extending central shaft bore extending inwardly a selected distance from said socket drive male end, and a shaft hole extending through said shaft and said central shaft bore;

said shaft including a groove extending circumferentially therearound at least a portion thereof for retaining a ring retaining means;

a slide having a selected cross-sectional width adapted to be received in said central shaft bore for longitudinal movement therein, said slide having an inner main body portion having a slide hole extending therethrough and a distal end forming a slide head, said slide including a tapered notch between said main body portion and said slide head;

a sleeve to be received coaxially around said shaft near said male end, said sleeve having a first portion of a selected internal diameter and a second portion of a selected reduced interval diameter forming a lip thereinbetween, said sleeve including a sleeve hole through said second portion;

a pin extending through said sleeve hole, said shaft hole, and said slide hole; and a spring extending coaxially around said shaft being compressed between said sleeve lip and said ring retaining means;

wherein forward motion of said sleeve toward said socket driven end releases said socket.

2. The socket wrench extension mounting arrangement of claim 1, wherein said shaft hole extending through said shaft, said central shaft bore, said slide, and said sleeve is transverse.

3. The socket wrench extension mounting arrangement of claim 1, wherein said groove for retaining a ring retaining means extends circumferentially around the entire shaft.

4. The socket wrench extension mounting arrangement of claim 1, wherein said ring retaining means is a "C-ring".

5. The socket wrench extension mounting arrangement of claim 1, wherein said tapered notch of said slide is less than the cross-sectional width of said slide main body portion.

6. The socket wrench extension mounting arrangement of claim 1, wherein said slide head is of a greater cross-sectional width than said slide main body.

7. The socket wrench extension mounting arrangement of claim 1, wherein said slide head is of a greater cross-sectional width than said slide main body and said slide head extends a uniform distance beyond the periphery of said slide main body.

8. The socket wrench extension mounting arrangement of claim 1, wherein said slide head is the same cross-sectional width as said slide main body.

9. The socket wrench extension mounting arrangement of claim 1, wherein said slide is cylindrical.

10. The socket wrench extension mounting arrangement of claim 1, wherein said slide main body comprises a cylindrical bottom surface, cylindrical side surfaces and a flat top surface, said tapered notch is of a lesser diameter than said slide main body, and said slide head is of a greater diameter than said slide main body.

11. The socket wrench extension mounting arrangement of claim 10, wherein said slide head has a bottom surface and side surfaces of equal cross-sectional width to said slide maim body and said top of said slide head is of a greater cross-sectional width than said main body.

12. The socket wrench extension mounting arrangement of claim 1, wherein said tapered notch of said slide is circumferential.

13. The socket wrench extension mounting arrangement of claim 1, wherein said tapered notch of said slide extends a depth of less than the center of said slide main body portion.

14. The socket wrench extension mounting arrangement of claim 1, wherein said slide head is conical.

15. A socket mounting arrangement, comprising:

a shaft having a socket drive stud at a socket drive male end;

said socket drive stud having at least one side wall for cooperatively engaging a cavity of a tool socket;

a projection extending a selected distance from an opening formed in said at least one side wall adapted for retaining said projection;

said shaft having an axially extending central shaft bore extending inwardly a selected distance from said socket drive male end, and a shaft hole extending through said shaft and said central shaft bore;

said shaft including a means for retaining a ring therearound;

a slide adapted to be received in said central shaft bore for longitudinal movement therein, said slide having an inner main body portion having a slide hole extending therethrough and a distal end forming a slide head, said slide including a notch thereinbetween;

a sleeve to be received coaxially around said shaft near said male end, said sleeve having a first portion of a selected internal diameter and a second portion of a selected reduced interval diameter forming a lip thereinbetween, said sleeve including a sleeve hole through said second portion;

a retaining means extending through said sleeve hole, said shaft hole, and said slide hole; and a spring extending coaxially around said shaft being compressed between said sleeve lip and said ring retaining means;

wherein forward motion of said sleeve toward said socket driven end releases said socket.

16. The socket mounting arrangement of claim 15, wherein said shaft hole extending through said shaft, said central shaft bore, said slide, and said sleeve is transverse.

17. The socket mounting arrangement of claim 15, wherein said means for retaining a ring is a groove extending circumferentially around the entire shaft.

18. The socket mounting arrangement of claim 15, wherein said ring retaining means is a "C-ring".

19. The socket mounting arrangement of claim 15, wherein said notch of said slide is less than the cross-sectional width of said slide main body portion.

20. The socket mounting arrangement of claim 15, wherein said projection is a latch ball.

21. The socket mounting arrangement of claim 15, wherein said slide head is of a greater cross-sectional width than said slide main body.

22. The socket mounting arrangement of claim 15, wherein said slide head is the same cross-sectional width as said slide main body.

23. The socket mounting arrangement of claim 15, wherein said slide is cylindrical.

24. The socket mounting arrangement of claim 15, wherein said slide main body comprises a cylindrical bottom surface, cylindrical side surfaces and a flat top surface, said tapered notch is of a lesser diameter than said slide main body, and said slide head is of a greater diameter than said slide main body.

25. The socket mounting arrangement of claim 24, wherein said slide head has a bottom surface and side surfaces of equal cross-sectional width to said slide maim body and said top of said slide head is of a greater cross-sectional width than said main body.

26. The socket mounting arrangement of claim 15, wherein said tapered notch of said slide is circumferential.

27. The socket mounting arrangement of claim 15, wherein said tapered notch of said slide extends a depth of less than the center of said slide main body portion.

28. The socket mounting arrangement of claim 15, wherein said slide head is conical.

* * * * *